US006079132A

United States Patent [19]

Clendenning

[11] Patent Number: 6,079,132

[45] Date of Patent: Jun. 27, 2000

[54] EXCAVATING TOOTH ASSEMBLY

[75] Inventor: Charles Clendenning, Broken Arrow, Okla.

[73] Assignee: H&L Tooth Co., Tulsa, Okla.

[21] Appl. No.: 08/938,909

[22] Filed: Sep. 26, 1997

[51] Int. Cl.[7] ..... E02F 9/28

[52] U.S. Cl. ..... 37/457; 37/454; 37/450

[58] Field of Search ..... 37/450, 454, 452, 37/455, 457, 456, 458; 403/150, 153, 297, 355

[56] References Cited

U.S. PATENT DOCUMENTS

| | | | |
|---|---|---|---|
| 3,406,471 | 10/1968 | Duplessis | 37/457 |
| 3,621,594 | 11/1971 | Hahn et al. | 37/457 X |
| 3,650,053 | 3/1972 | Baer | 37/457 |
| 3,707,788 | 1/1973 | Sturgeon | 37/457 |
| 4,338,736 | 7/1982 | Radigan | 37/142 A |
| 4,516,340 | 5/1985 | Launder | 37/142 A |
| 4,727,663 | 3/1988 | Hahn | 37/142 A |
| 5,272,824 | 12/1993 | Cornelius | 37/458 |
| 5,435,084 | 7/1995 | Immel | 37/457 X |
| 5,456,029 | 10/1995 | Cornelius | 37/456 |
| 5,617,655 | 4/1997 | Launder et al. | 37/457 |
| 5,765,301 | 6/1998 | Clendenning | 37/457 |

*Primary Examiner*—Victor Batson
*Attorney, Agent, or Firm*—John W. Harbst

[57] ABSTRACT

A multipiece excavating tooth assembly including an adapter and an excavating tooth. A fastener releasably interconnects and maintains the excavating tooth in operable combination with the adapter. When assembled, an elongated nose portion of the adapter extends into a blind cavity defined by and which opens to a rear end of the excavating tooth. The adapter and tooth define a pair of fore-and-aft spaced stabilizing lands for advantageously transferring impact forces imparted to the tooth assembly during an excavating operation. Each stabilizing land on the tooth assembly is comprised of a pair of generally horizontal flats arranged in confronting relation relative to each other when the excavating tooth is arranged in operable combination with the adapter. Each stabilizing land further includes a generally vertical stabilizing wall arranged in at least partially surrounding relation relative to the flat.

30 Claims, 5 Drawing Sheets

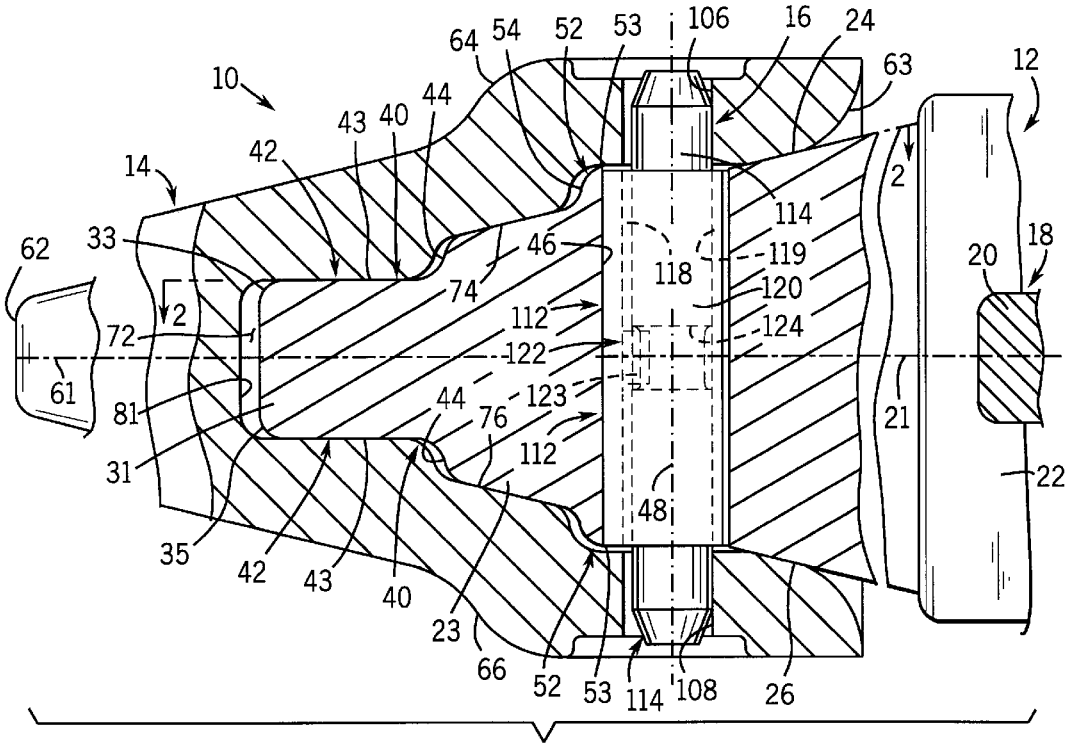
FIG. 1
FIG. 2
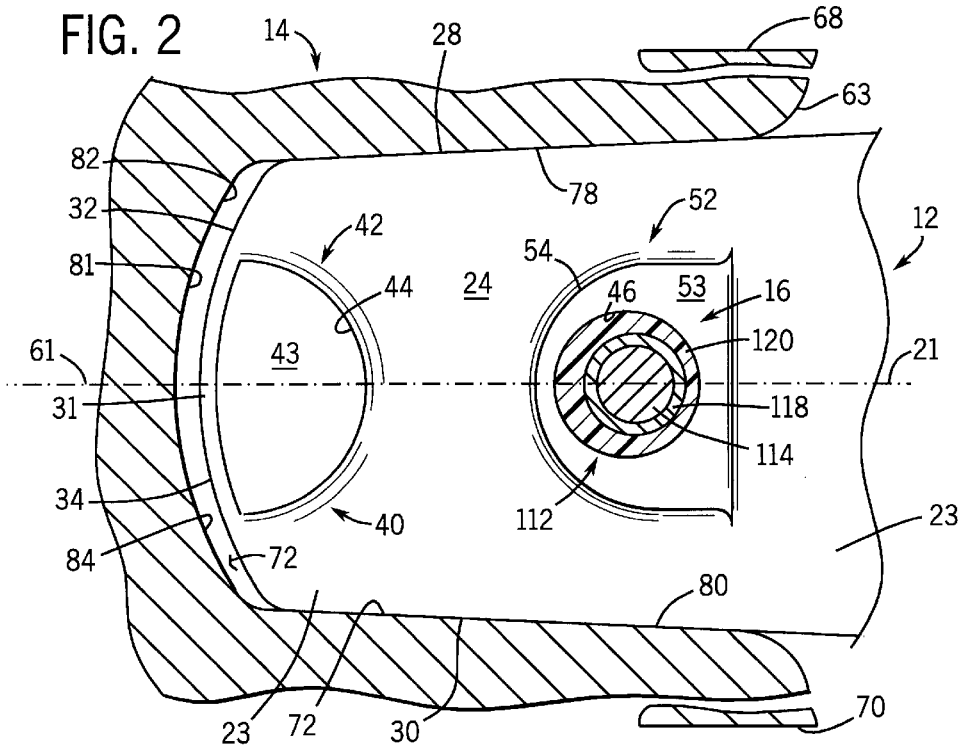

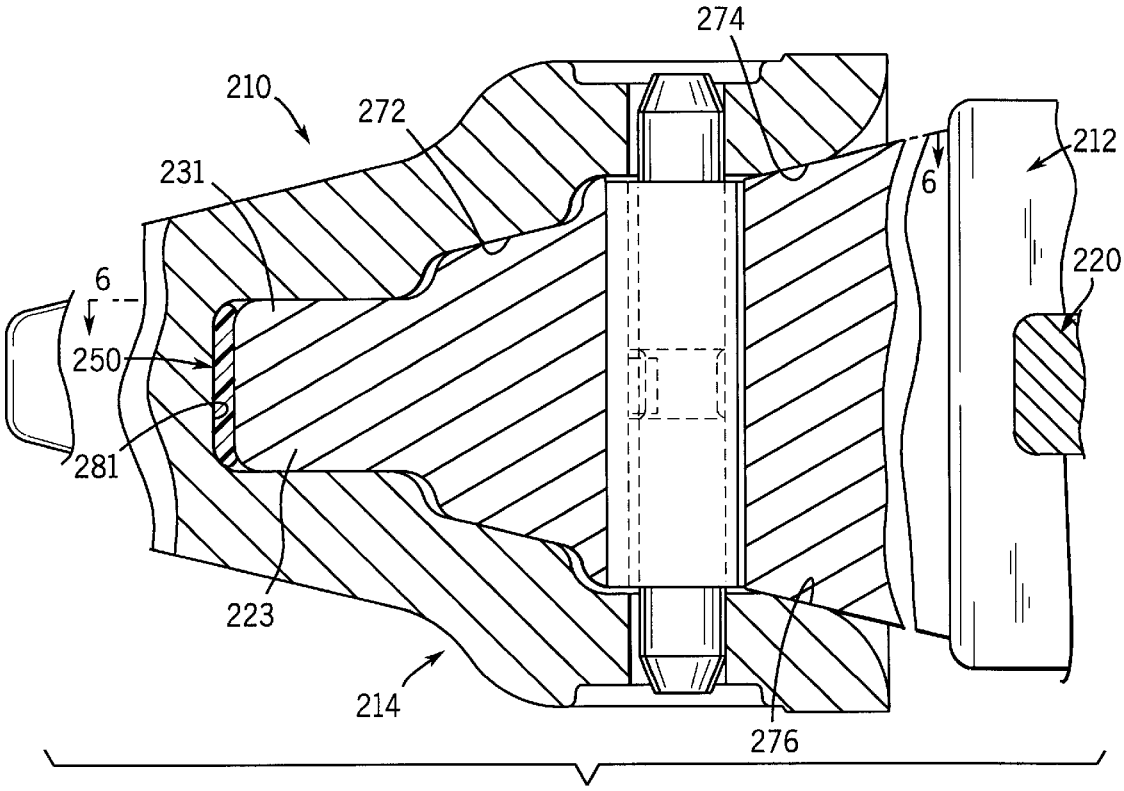
FIG. 5
FIG. 6
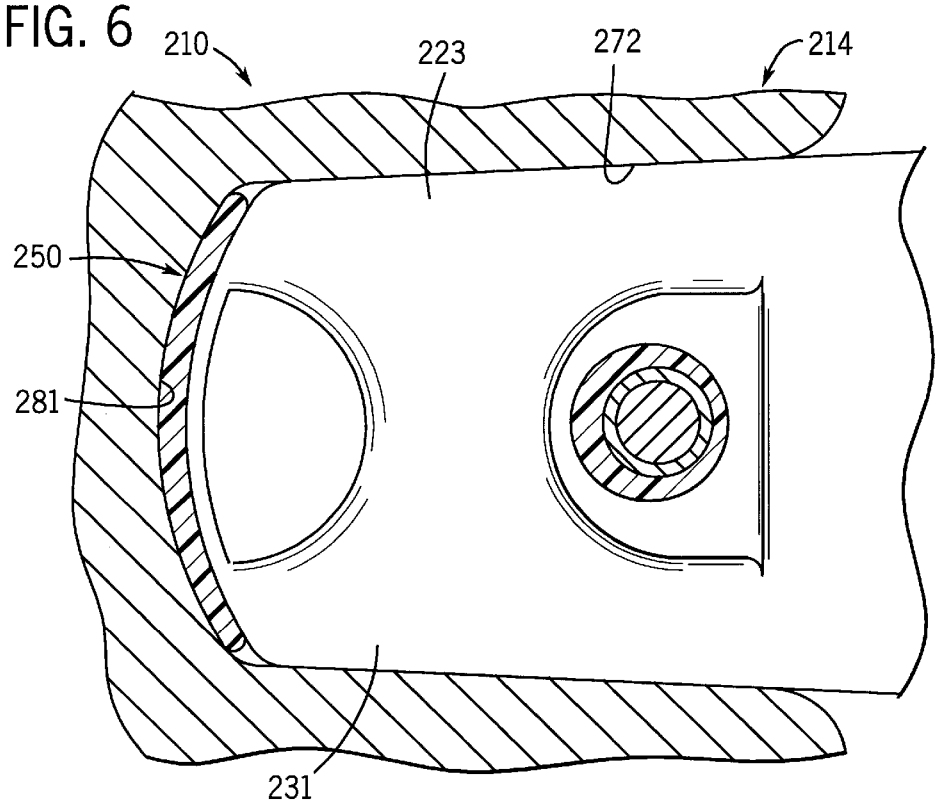

FIG. 7
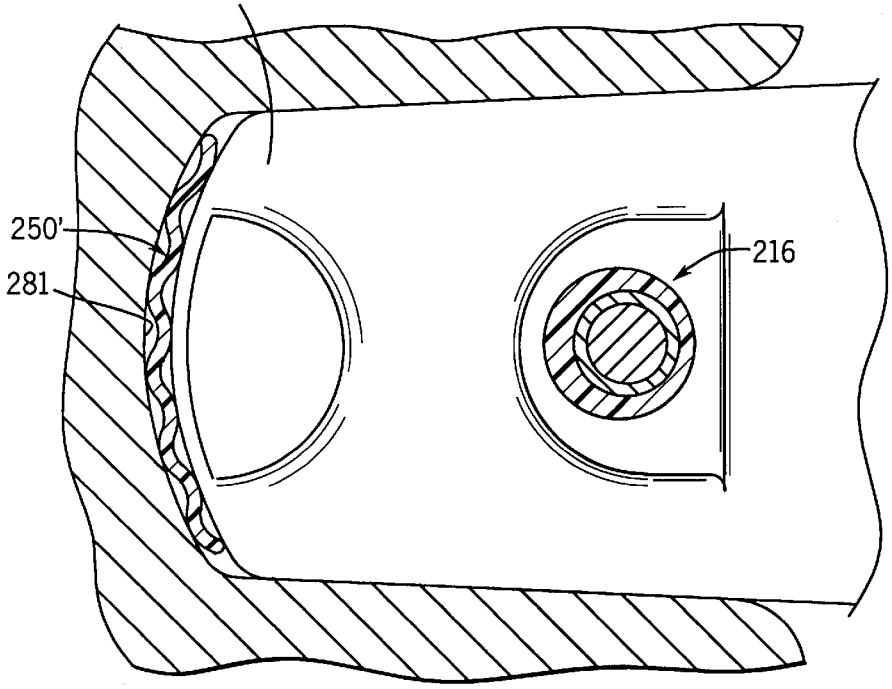
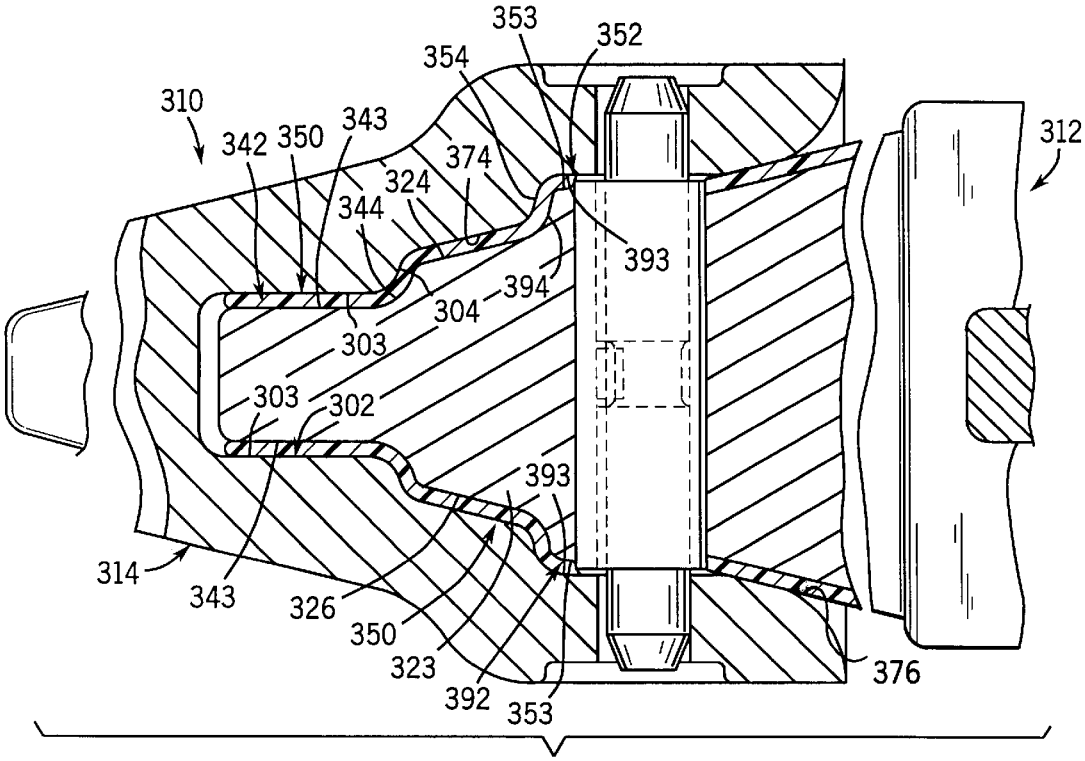
FIG. 8

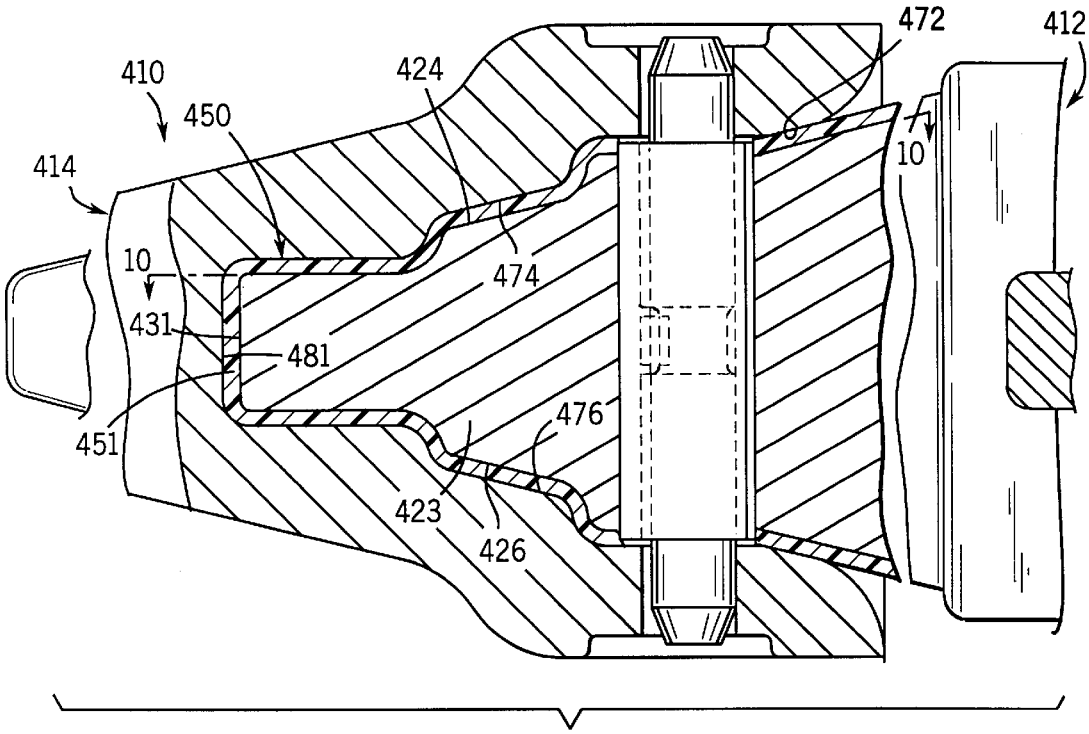
FIG. 9
FIG. 10
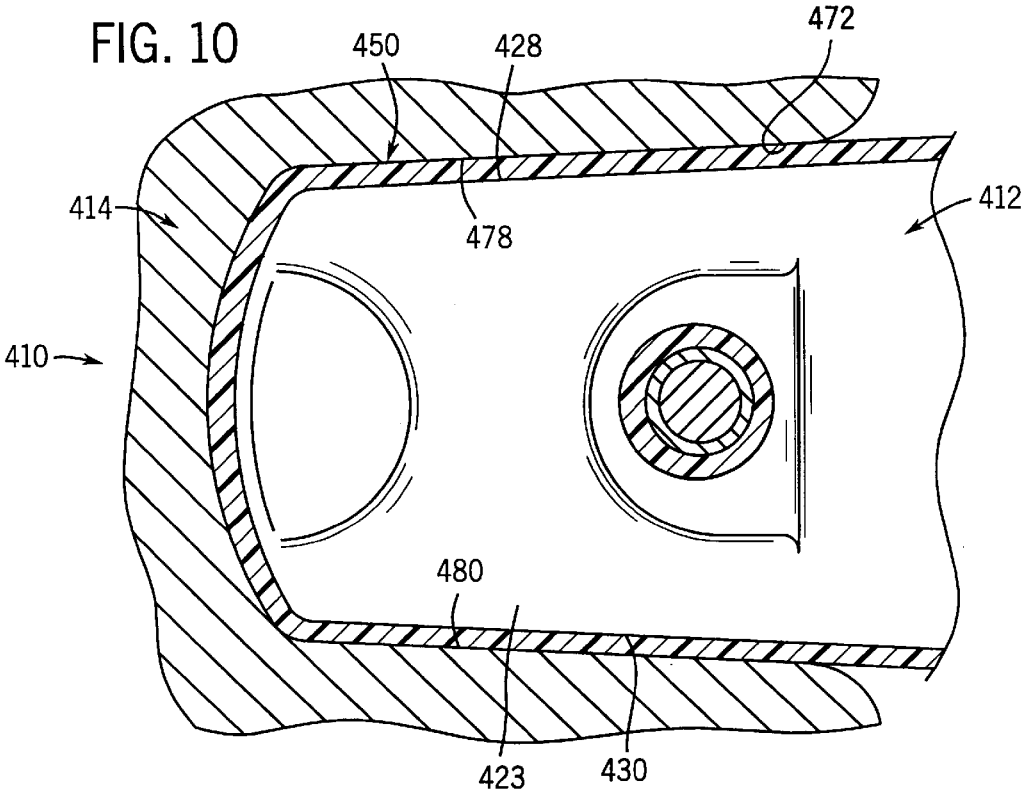

EXCAVATING TOOTH ASSEMBLY

FIELD OF THE INVENTION

The present invention relates generally to an excavating tooth assembly for a shovel or dipper bucket of large excavating equipment, and more particularly, to a mating configuration of an adapter and an excavating tooth which improves the being surfaces for absorbing vertical loads and inhibits lateral movement of the excavating tooth with respect to the adapter during use.

BACKGROUND OF THE INVENTION

Earthworking tools such as excavating teeth are commonly known in the industry for use in conjunction with earthmoving implements such as shovels or dipper buckets. Typically, such teeth are mounted on spaced apart adapters or nose pieces of the implement to facilitate repair and, when necessary, replacement of the teeth should they become broken or dull. Periodic replacement is often necessary since the tools are subject to extreme loads and wear due to operating conditions where they encounter rock, sand and other types of abrasive earthen materials.

The adapters are generally configured with a nose portion having a triangular or tapered portion when viewed in longitudinal section. The excavating teeth are also provided with a generally triangular or tapered cavity or hollow for a mating fit with the nose portion of the adapters. To secure the excavating tooth to the adapter, and to allow for replacement of the tooth, a removable fastener such as a retaining pin is typically inserted through opposing holes in the excavating tooth and through a bore in the adapter.

As will be appreciated by those skilled in the art, the bore is formed in the adapter and the opposing holes are formed in the excavating tooth with exacting accuracy and preciseness to assure an appropriate and mating fit between the parts. As will be appreciated, an error in placement of the bore in the adapter or the opposing holes in the digging tooth can result in poor mating between confronting surfaces on the tooth and the adapter. Such misfittings can cause significant problems resulting in undue wear between the component parts during operation of the digging or excavating tooth assembly.

In response to the tremendous forces exerted on the digging tooth during excavation, the tooth tends to move laterally, vertically or rotationally relative to the adapter, thereby causing undesirable wear on the respective parts. Moreover, during an excavating operation tremendous forces are placed on the removable fastener used to hold the excavating teeth on to their respective adapter. As a result of the forces acting on the tooth, the pin often becomes loose and fails to operably hold the tooth onto the adapter. Accordingly, the tooth separates from the adapter causing additional problems during the excavating operation.

Thus, there is a continuing need and desire for an excavating tooth assembly which is configured to optimize distribution of forces between the components thereof and prevent undesirable movement therebetween in order to minimize the frequency with which the parts must be replaced, thereby reducing the overall number of replacement parts and the time required to perform the replacement operations. Also, there continues to be a need and a desire for an excavating tooth assembly which is specifically designed to enhance the holding ability of the removable retainer thereby inhibiting inadvertent separation and loss of the excavating tooth relative to the adapter.

SUMMARY OF THE INVENTION

In view of the above, and in accordance with the present invention, there is provided an excavating tooth assembly including an adapter and an excavating tooth. To promote its repair and, if necessary, replacement, a fastener maintains the excavating tooth in operable relationship with and releasably connected to the adapter. The excavating tooth preferably has a hollow mounting end defining a cavity configured to mate with a nose portion of the adapter. The hollow mounting end of the tooth includes inner tapered surfaces adapted to mate with outer tapered surfaces on the nose portion of the adapter.

In one aspect of the invention, the outer tapered surfaces of the adapter are each configured with a pair of fore-and-aft spaced stabilizing land sections. Each stabilizing land section on the nose portion of the adapter defines a flat surface extending generally parallel to the centerline of the adapter. Additionally, each stabilizing land section on the adapter has a substantially vertical stabilizing wall extending thereabout for advantageously transmitting forces acting on the tooth assembly toward a centerline of the adapter thereby enhancing performance characteristics of the tooth assembly.

The inner tapered surfaces at the hollow mounting end of the tooth each have a configuration complementary to that on the outer surface on the adapter. That is, the inner tapered surfaces at the hollow mounting end of the excavating tooth each have a pair of fore-and-aft spaced stabilizing lands or transmitting sections. Each stabilizing land on the tooth likewise defines a flat extending generally parallel to the longitudinal axis of the tooth and sized relative to the lands on the adapter to readily and easily allow the tooth assembly to slidably fit endwise over and about the adapter. As will be appreciated, the rearmost stabilizing land or transmitting section on the tooth is adapted to mate with the rearmost stabilizing land section on the adapter while the foremost flat or transmitting section on the tooth is adapted to mate with the foremost land section on the adapter.

In a preferred form of the invention, each stabilizing land on the adapter and excavating tooth further includes a substantially vertical wall expending from the flat defined by the respective stabilizing land. The generally vertical stabilizing walls of the stabilizing lands on the tooth are configured to mate with the corresponding stabilizing walls on the respective land sections on the adapter to facilitate transmission of forces between the excavating tooth and the adapter during operation of the excavating tooth assembly.

In another aspect of the invention, a bore extends through the rearward land section of the adapter, and a hole extends through the rearward stabilizing lands or transmitting sections of the tooth to act in conjunction with the bore for the insertion of a fastener therethrough to secure the tooth to the adapter. As will be appreciated, providing a generally horizontal flat on the adapter facilitates location and fabrication of the bore by inhibiting the tool used to make the bore from "dancing" along the angled surface of the adapter. That is, the flats defined by the rear stabilizing lands of the adapter are each intersected by and generally surround the centerline of the bore extending through the adapter for accommodating the fastener used to releasably interconnect the excavating tooth to the adapter. Thus, fabrication costs are reduced and the accuracy of the bore dimensions can be more precisely controlled.

In a preferred form of the invention, the generally vertical stabilizing walls of the land sections on the adapter and excavating tooth have complementary shapes to promote the transfer of forces acting on the tooth to the adapter and, thus, to the implement, thereby significantly aiding in the distribution of the relatively large forces acting on the excavating teeth. To further facilitate the transmission of lateral forces acting on the tooth, a forward end portion of the adapter is bowed outwardly and a forward end portion of the cavity in the tooth is a corresponding concave shape for matingly receiving said nose piece.

The present invention provides significant advantages over other excavating tooth assemblies. By providing multiple horizontal and vertical stabilizing surfaces which mate in abutting relationship, especially in the vicinity of the bore in the adapter and the holes in the tooth, the transmission of vertical and horizontal forces from the excavating tooth to the adapter is optimized. As will be appreciated by those skilled in the art, the ability to effectively transfer forces between the adapter and the excavating tooth furthermore reduces wear between the component parts of the tooth assembly thus resulting in cost savings for replacement parts and labor.

According to another aspect of the present invention, elastomeric material is disposed between the adapter and the tooth to inhibit movement between the component parts of the tooth assembly thereby blunting the transference of forces between the tooth and the adapter and, thus, prolonging the usefulness of the engaging surfaces on the digging tooth assembly. In one form of the invention, an elastomeric spring is provided between the forward end portion of the adapter and the internal wall defined by the cavity in the tooth for continually urging the mating surfaces defined on the excavating tooth and the adapter into positive engagement relative to each other. Besides acting to blunt endwise impact forces between the tooth and the adapter, this elastomeric material furthermore augments the holding ability of the fastener extending through the tooth and the adapter. In another form of the invention, elastomeric material is arranged along, and preferably about the adapter to resiliently fill tolerance voids and gaps between the components of the tooth assembly thereby blunting the impact forces inherent between such components during operation of the tooth assembly.

The present invention, together with further objects and advantages, will be best understood by reference to the following detailed description taken in conjunction with the accompanying drawings.

BRIEF DESCRIPTION OF THE DRAWINGS

FIG. 1 is a longitudinal sectional view of one form of a multipiece excavating tooth assembly according to the present invention;

FIG. 2 is a sectional view taken along line 2—2 of FIG. 1;

FIG. 5 is a longitudinal sectional view similar to FIG. 1 showing an alternative form of a multipiece excavating tooth assembly including elastomeric material disposed between components of the tooth assembly;

FIG. 6 is a sectional view taken along line 6—6 of FIG. 5;

FIG. 7 is a sectional view similar to FIG. 6 but showing an alternative form of elastomeric material disposed between components of the excavating tooth assembly;

FIG. 8 is a longitudinal sectional view similar to FIG. 1 showing another alternative form of a multipiece excavating tooth assembly including elastomeric material disposed between components of the tooth assembly;

FIG. 9 is a longitudinal sectional view similar to FIG. 1 showing still another alternative form of a multipiece excavating tooth assembly including elastomeric material disposed between components of the tooth assembly; and FIG. 10 is a sectional view taken along line 10—10 of FIG. 9.

DETAILED DESCRIPTION OF THE PREFERRED EMBODIMENT

Figure 3:
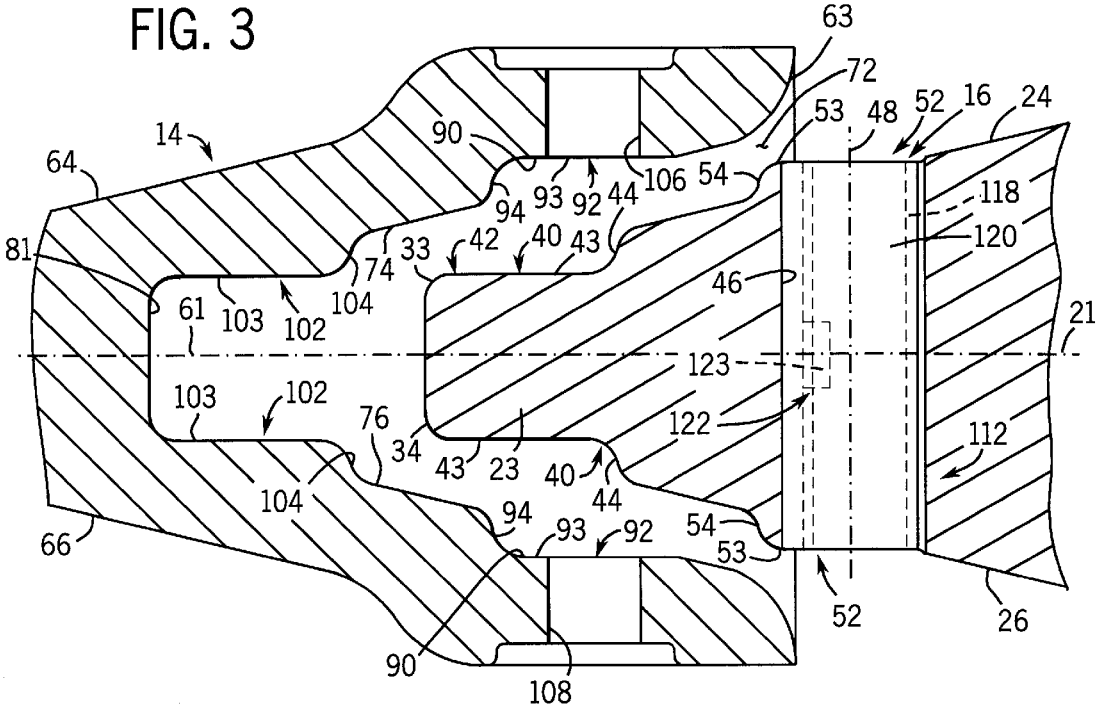
FIG. 3 is a longitudinal sectional view similar to FIG. 1 but showing components of the multipiece excavating tooth assembly of the present invention in axially separated relation relative to each other.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals refer to like parts throughout the several views, there is shown in FIG. 1 an excavating tooth assembly 10 including an adapter or support 12 and an excavating tooth 14. An elongated fastener 16 releasably interconnects and maintains the adapter 12 and tooth 14 in operating relationship relative to each other.

Although only a single tooth assembly 10 is shown in FIG. 1 as being attached to an excavating implement 18 such as a forward lip 20 of a bucket or the like, it will be understood by those skilled in the art that on typical excavating equipment, a plurality of spaced apart tooth assemblies, substantially identical to the tooth assembly 10, would extend from the bucket lip 20. Moreover, and as used herein, the terms horizontal and vertical refer generally to the orientation of the excavating implement or equipment when disposed on the ground, and wherein the excavating movement of the bucket 18 would be primarily in the vertical direction, although horizontal loads and forces are also imparted on the tooth assembly 10 during a normal excavating operation.

Figure 4:
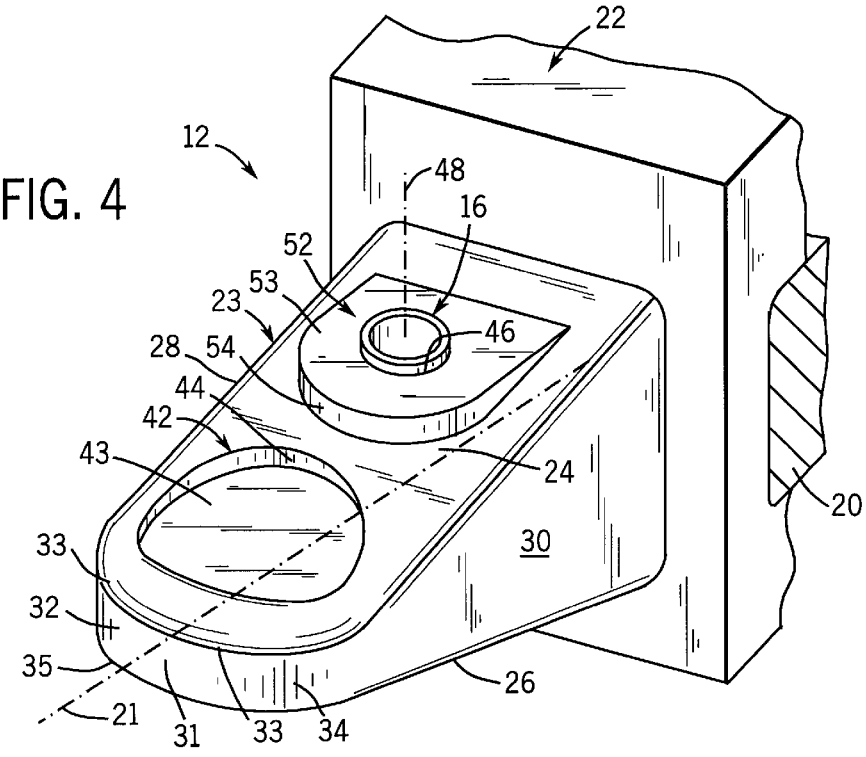
FIG. 4 is a perspective view of an adapter forming part of the excavating tooth assembly.

As illustrated in FIGS. 1 and 4, the adapter or support 12 has an elongated configuration defining a longitudinal centerline 21. The adapter or support 12 includes a conventional base portion 22 and a axially aligned nose portion 23 extending forwardly from and preferably formed integral with the base portion 22. The base portion 22 is preferably configured for releasable securement, as by a conventional wedge locking mechanism (not shown), to the forward lip 20 of the shovel or dipper bucket 18 of the earth excavation apparatus. As is conventional, the excavating tooth 14 fits endwise along and about the nose portion 23 of the adapter.

As shown, the nose portion 23 of the adapter or support 12 has a forwardly tapered configuration including angularly converging top and bottom exterior surfaces 24 and 26, respectively, for mating with and carrying the tooth 14. The nose portion 23 of the adapter or support 12 further includes laterally spaced side walls 28 and 30 (FIGS. 2 and 4). In the preferred form of the invention, the laterally spaced side walls 28, 30 likewise have a slight forwardly tapering slant thereto in the longitudinal direction thereof. Otherwise, the side walls 28, 30 each have a vertical orientation and are generally parallel to each other.

In the embodiment of the invention illustrated in FIGS. 1, 2 and 4, a terminal end region 31 of the nose portion 23 of the adapter 12 defines a pair of laterally slanted surfaces 32 and 34 that laterally and angularly diverge away from the centerline 21 of the adapter 12. In the illustrated form of the invention, and to facilitate fabrication of the adapter 12, the terminal end portion 31 of the adapter 12 defines an outwardly bowed, curved terminal end portion. As will be appreciated, the laterally curved configuration at the terminal end 31 of the adapter 12 provides surfaces which, when a line is drawn tangential thereto, form an acute or diverging angle relative to the longitudinal centerline 21 of the adapter 12.

Moreover, in a preferred form of the invention, the free or terminal end portion 31 of the adapter 12 is provided with an upper radius 33 and a lower radius 35 at the juncture of the upper and lower surfaces 24 and 26, respectively. This configuration of the distal end of the adapter 12 assists in stabilizing the tooth 14 and provides a self-centering feature when the tooth 14 is under horizontal side loads.

The exterior slanted surfaces 24 and 26 on the support or adapter 12 each have recessed areas 40 arranged toward a distal end of the adapter 12. Preferably, the recessed areas 40 are equally disposed on the surfaces 24 and 26 and relative to the longitudinal centerline 21 of the adapter 12. Each recessed area 40 defines a flat substantially horizontal stabilizing surface or forward land 42 on the adapter 12.

Each land 42 protrudes inwardly from the respective slanted surfaces 24, 26 on the adapter 12 to define a generally flat or horizontal surface 43 extending generally parallel to the axis 21 of the adapter 12. As will be appreciated, a predetermined vertical distance is measurable between the flat or generally horizontal surfaces 43 of the lands 42 on the surfaces 24, 26 of the adapter 12. Moreover, each forward land 42 is bordered by a curvilinear and generally vertical stabilizing wall 44. As will be described below, the horizontal forward lands 42 provide greater load distribution to absorb extreme vertical loads imparted to the tooth assembly during operation while the vertical stabilizing walls 44 provide additional vertical bearing surfaces to assist in absorbing extreme horizontal loads imparted to the tooth assembly 10 during an excavating operation.

As is conventional in multipiece tooth assemblies, the adapter 12 is further provided with a bore 46 for accommodating endwise passage of the fastener 16 therethrough thereby permitting the tooth 14 to be releasably maintained in operable association with the support or adapter 12. In the illustrated form of the invention, bore 46 defines an axis 48 extending vertically through a rearward portion of the tapered extension 23 of adapter 12 and opens to the tapered surfaces 24 and 26. As will be appreciated by those skilled in the art, the bore 46 accommodates endwise passage of the fastener 16 through the adapter or support 12. The bore 46 is suitably formed in the adapter 12 preferably using a drill but a punch may also be used in some circumstances.

The adapter 12 further defines a pair of flat substantially horizontal stabilizing surfaces or rearward lands 52 on the slanted surfaces 24 and 26 of the support 12 in surrounding relation relative to the axis 48 of the bore 46. As shown in FIG. 1, the lands 52 are equally disposed on the surfaces 24 and 26 and relative to the longitudinal axis 21 of the adapter 12. Each land 52 protrudes outwardly from the respective slanted surface 24, 26 of the adapter 12 to define a generally horizontal or flat surface 53 extending generally parallel to the axis 21 of the adapter 12. A predetermined vertical distance is measurable between the flats or generally horizontal surfaces 53 defined by the lands 52 on the surfaces 24, 26 of the adapter 12.

As with the forward lands 42, the rearward lands 52 define curvilinear vertical stabilizing walls 54 extending thereabout. The walls 54 provide additional vertical bearing surfaces to assist in absorbing extreme horizontal loading imparted to the tooth assembly 10. In particular, side load distribution is transferred from horizontal to vertical in the areas of the adapter 12 surrounding the bore 46. The rearward lands 52 also provide greater vertical load distribution to absorb extreme vertical loads. Thus, the combination of the forward and rearward lands 42 and 52, respectively, substantially increases the stability of the tooth assembly 10 over a vast range of forces acting thereon during operation of the tooth assembly 10. Moreover, the additional material provided by the rearward lands 52 strengthens the area of the adapter surrounding the bore 46, which is typically the weakest area of the adapter 22.

It will be appreciated that although the terminal end portion 31 and the vertical stabilizing walls 44, 54 of the adapter 12 are preferably curvilinear, they could define other shapes capable of absorbing horizontal loads acting on the adapter 12. For example, the terminal end portion 31 and vertical stabilizing walls 44, 54 could each be configured with a V-shape since both sides of the "V" are eschewed or divergent from the centerline 21 of the adapter 12.

When the excavating tooth 10 is assembled, the excavating tooth 14 is configured for endwise accommodation along and about a lengthwise portion of the nose portion 23 of the adapter 12. As shown in FIG. 1, the excavating tooth 14 has an elongated configuration defining a longitudinal axis 61 and with a lateral cutting edge 62 extending generally transverse to axis 61 disposed at one end thereof and a hollow mounting end 63 disposed at an opposite end thereof for allowing the tooth 14 to be mounted endwise onto the adapter 12.

As shown, the tooth 14 includes upper and lower exterior surfaces 64 and 66, respectively, which extend rearwardly from the cutting edge 62 and extend toward the rear end 63 of the tooth 14. As the surfaces 64, 66 extend rearwardly from the edge 62, they angularly diverge away from each other. In the illustrated form of the invention, the upper and lower surfaces 64, 66 on the tooth 14 preferably have substantially corresponding radii. Moreover, and as shown in FIG. 2, the tooth 14 has a pair of laterally spaced side walls 68 and 70 which have a slightly tapering longitudinal configuration and which extend vertically and generally parallel relative to each other between the upper and lower surfaces 64 and 66, respectively, of the tooth 14.

As is conventional in multipiece tooth assemblies, the tooth 14 defines a blind cavity 72 (FIG. 3) opening to the rear end 63 of the tooth 14. The shape of the cavity 72 generally corresponds in configuration to the tapered extension 23 of the adapter 12 so that the tooth 14 can fit endwise thereon in mating relationship relative to the adapter 12. In a preferred form, the edge of the cavity 72 defined by the tooth 14 has an inwardly directed radius 73 (FIG. 3) extending thereabout to facilitate and guide endwise insertion of the nose portion 23 of the adapter 12 into a mating relationship or fit with the tooth 14.

As illustrated in FIGS. 1 and 3, the cavity 72 defined by tooth 14 includes upper and lower interior surfaces 74 and 76, respectively, extending forwardly from the open rear end of the cavity 72 toward the forward edge 62 (FIG. 1) of the tooth 14 and converging toward each other at substantially the same angle that the exterior surfaces 24 and 26 are disposed on the nose region 23 of the adapter 12. As shown in FIG. 2, a pair of generally vertical interior side walls 78 and 80 further serve to define the cavity 70. As will be appreciated, the interior side walls 78 and 80 of cavity 70 are configured to accommodate and mate with the exterior side walls 28 and 30, respectively, on the nose region of the adapter 12.

In the embodiment of the invention illustrated in FIGS. 2 and 3, the interior slanted surfaces 74 and 76 of cavity 72 converge toward each other and terminate in an end wall 81 defining a pair of laterally slanted surfaces 82 and 84. The laterally slanted surfaces 82 and 84 angularly diverge away from the centerline 61 of the tooth 14. In the preferred form of the invention, and as shown in FIG. 2, the laterally slanted surfaces 82, 84 defined by end wall 81 generally parallel the laterally slanted surfaces 32 and 34 defined at the terminal end portion 31 of adapter 12. In a most preferred form of the invention, and to facilitate fabrication of the cavity 32 defined by tooth 14, the terminal end wall 81 of cavity 72 defines a concavely bowed surface that generally parallels the bowed surface at the terminal end portion 31 of the nose portion of adapter 12.

As illustrated in FIG. 3, the interior slanted surfaces 74 and 76 of cavity 72 have recessed areas 90 arranged toward the open end of the cavity 72 defined by tooth 14. The recessed areas 90 define rear stabilizing lands 92 disposed on the surfaces 74 and 76 of cavity 72 so as to mate with the pair of rearward stabilizing lands 52 on the nose portion 23 of the adapter 12.

In the illustrated form of the invention, the stabilizing lands 92 are equally disposed on the surfaces 74 and 76 and relative to the longitudinal axis 61 of the tooth 14. Each stabilizing land 92 protrudes inwardly from the respectively slanted surface 74, 76 of cavity 72 on the tooth 14 to define a generally flat or horizontal surface 93 extending generally parallel to the axis or longitudinal centerline 61 of the tooth 12. A predetermined vertical distance equal to or somewhat greater than the vertical distance between the rearward lands 52 on the adapter 12 separates the generally parallel surfaces 93 defined on the interior surfaces 74 and 76 of the cavity 72 defined by tooth 14. Additionally, each flat or horizontal surface 93 is bordered by a curvilinear generally vertical stabilizing wall 94. Suffice it to say, the stabilizing wall 94 has a configuration which complements and generally corresponds to the stabilizing wall 54 arranged in surrounding relation relative to the rearward lands 52 defined on the nose portion 23 of adapter 12.

The slanted upper and lower interior surfaces 74, 76 defined by cavity 72 of tooth 14 furthermore include a pair of forward stabilizing lands 102 arranged toward and rearwardly extending from the terminal wall 81 of the cavity 72. The stabilizing lands 102 are disposed on the surfaces 74 and 76 of cavity 72 so as to mate with the pair of forward lands 42 on the nose portion 23 of the adapter 12.

In the illustrated form of the invention, the stabilizing lands 102 protrude from the slanted surfaces 74, 76 of cavity 72 and are equally disposed on the surfaces 74, 76 and relative to the longitudinal axis 61 of the tooth 14. Each stabilizing land 102 defines a generally flat or horizontal surface 103 extending generally parallel to the longitudinal axis or center line 61 of the tooth 14. A predetermined vertical distance equal to or somewhat greater than the predetermined vertical distance between the forward lands 42 on the adapter 12 separates the generally parallel surfaces 103 defined on the interior slanted surfaces 74, 76 of the cavity 72 defined by tooth 14. By this design, the tooth 14 can be endwise fitted along and about a lengthwise portion of the nose portion 23 of the adapter 12 without the various pairs of stabilizing surfaces on the adapter 12 and tooth 14 interfering with each other during assembly of the tooth assembly 10.

Additionally, each stabilizing land 102 is bordered by a curvilinear and generally vertical stabilizing wall 104. Suffice it to say, the stabilizing wall 104 of stabilizing land 102 has a configuration which compliments and generally corresponds to the stabilizing wall 44 arranged in surrounding relation relative to the pair of forward lands 42 on the nose portion 23 of the adapter 12. As will be appreciated by those skilled in the art, if other configurations of the stabilizing walls 44, 54 or 94, 104 were provided on the adapter 12 or tooth 14, the complimentary or associated surface on the mating component of the tooth assembly 10 would be correspondingly shaped to mate therewith.

The tooth 14 further defines a pair of axially aligned holes or openings 106 and 108 for accommodating endwise passage of the fastener 16 therethrough thereby permitting the tooth 14 to be releasably attached and maintained in operable connection with the adapter 12. The relationship of the openings 106, 108 relative to the bore 46 in the adapter 14 is important to maintain the fastener 16 in operable relation with the tooth assembly during excavating operations. In the illustrative form of the invention, and because of the preferred disposition of bore 46 defined by adapter 12, the holes or openings 106, 108 are arranged in general vertical relationship relative to each other.

The fastener 16 for releasably interconnecting and maintaining the adapter 12 in tooth 14 in operable relation relative to each other can take many forms. In the illustrated embodiment, the fastener 16 is preferably of the type disclosed in co-assigned U.S. Pat. No. 5,765,301 issued to C. Clendenning on Jun. 16, 1998; the full disclosure of which is incorporated herein by reference.

As shown in FIG. 1, fastener 16 preferably comprises an elongated insert 112 and a retaining pin 114. The insert 112 includes a rigid elongated cylindrical sleeve 118 surrounded by a resilient member 120. Sleeve 118 is preferably fabricated from steel or the like and defines an internal bore 119 which opens to opposite ends of the sleeve 118. As shown in FIG. 1, the insert 112 has a length generally equal to the predetermined distance separating the flats 53 defined by the stabilizing lands 52 on the slanted surfaces 24 and 26 of the nose portion 23 of adapter 12. Preferably, the resilient member 120 surrounds about a 270° circumferential portion of the sleeve 18 such that a portion of the sleeve is preferably free of resilient material before the insert 112 is inserted into combination with the adapter 12. Such design provides for compression relief for the insert 112 when inserted into the bore 46 of the adapter 12 and retaining pin 14 is inserted therethrough. Preferably, the outside diameter of the insert 112 is slightly greater than the diameter of the bore 46 and the adapter 12 so that the insert 112 is a light drive-in fit into the bore 46 of the adapter 12. A locking mechanism 122 including locking member 123 embedded in the resilient member 120 of insert 112 is disposed along the length of the insert 112 for releasably maintaining the retaining pin 114 in operable association therewith.

The retaining pin 114 of fastener 16 is preferably formed from solid steel and has a length greater than that of insert 112. The outside diameter of pin 114 is slightly less than the diameter of the axially aligned holes 106, 108 defined in the tooth 14. In the illustrated embodiment, opposite ends of pin 114 are chamfered to facilitate insertion of pin 114 into the insert 112. In the embodiment illustrated in FIG. 1, pin 114 defines an annular channel or recess 124 which combines with the locking member 123 of locking mechanism 122 to releasably hold the retaining pin 114 in operable relation to insert 112.

To assemble the excavating tooth assembly 10, tooth 14 is placed endwise along and about a lengthwise portion of the tapered nose portion 23 of adapter 12 such that the opposed holes 106, 108 in the tooth 14 generally align with the bore 46 in the adapter 12. The retaining pin 114 is then inserted through either opening 106, 108 and through the insert 112. As the retaining pin 114 moves endwise through the insert 112, tooth 14 is biased rearwardly along the adapter 12 thereby maintaining a tight fit between tooth 14 and the adapter 12. Preferably, the openings or holes 106, 108 defined in the tooth 14 are intentionally offset or misaligned in a fore-and-aft direction relative to the bore 46 defined in adapter 12 to provide the desired biasing effect. Moreover, the resilient member 120 serves to bias retaining pin 114 in the desired rearward direction. As shown in FIG. 1, the effect of these biasing features is to force the retaining pin 114 against the rear portion of the holes 106, 108 defined by tooth 14. Moreover, when the annular channel or recess 124 on retaining pin 114 passes the locking mechanism 122, the locking member 123 automatically snaps into snug locking relationship with the pin 114 under the influence of the resilient member 120 thereby fixedly holding the retaining pin 114 in place relative to the insert 112. During operation of the excavating tooth assembly 10, the resilient member 120 holds the locking member 123 tight against the retaining pin such that the pin 114 is inhibited from endwise travel and through the holes 106, 108 defined by tooth 14.

When the tooth 14 is assembled on to the adapter 12, tooth 14 is prevented from rotating about either axes 21 or 61 by the fastener 16. Moreover, when the excavating tooth assembly 10 is assembled, the fore-and-aft spaced pairs of cooperating stabilizing lands 42, 102 and 52, 92 defined on the adapter 12 in excavating tooth 14 furthermore minimize movement of the component parts of the tooth assembly relative to each other. More specifically, the generally flat surfaces 43 on the forward stabilizing lands of the adapter 12 are disposed and dimensioned so as to be arranged in operable relationship with the flat surfaces 103 on the forward stabilizing lands 102 of tooth 14. Similarly, the generally flat or horizontal surfaces 53 of the rear stabilizing lands 52 on the adapter 12 are disposed and dimensioned so as to be arranged in abutting relationship with the generally flat or horizontal surfaces 93 on the rear stabilizing lands 92 of tooth 14.

As will be readily appreciated by those skilled in the art, the cooperative relationship of the flats 43, 103 and 53, 93 on adapter 12 and tooth 14, respectively, are specifically intended to inhibit any significant movement between the components of the tooth assembly 12 and to promote advantageous transference of forces imparted to the tooth assembly 10 during an excavating operation toward the centerline of the tooth assembly 10 and ultimately to the bucket lip 20. Moreover, the cooperative relationship between the stabilizing walls 44, 104 defined by the complimentarily disposed stabilizing lands 42, 102 on the adapter 12 and tooth 14, respectively, advantageously facilitate transference of forces imparted to the tooth assembly 10 during an excavating operation. Similarly, and as best shown in FIG. 1, the stabilizing walls 54 and 94 defined by the complimentarily disposed lands 52 and 92 on the adapter 12 and excavating tooth 14, respectively, furthermore aid in the advantageous transference of forces imparted to the tooth assembly 10 during an excavating operation.

When a tooth 14 is to be repaired or replaced, a punch (not shown) is used to drive the fastener 16 through the tooth 14 and out of engagement with the adapter 12. The chamfered or beveled like configuration at opposite ends of the pin 114 of fastener 16 advantageously allows the pin 114 to be driven in either direction and is in effect reversible in operation. Once pin 114 is removed from operable association with insert 112, tooth 14 is removable to allow repair or replacement thereof. After a repaired/replacement tooth 14 is again fitted about and along the nose portion 23 of the adapter 12, the fastener 16 is reinserted to releasably interconnect the repaired/replacement tooth to the adapter. An advantage to using the type of fastener illustrated in the drawings is that the pin 114 does not have to be orientated in any specific manner for insertion, thus minimizing the chances for improper installation of the fastener 16.

As will be appreciated by those skilled in the art, providing the stabilizing lands 52 toward the rear end of the adapter 12 furthermore enhances accurate locating of the bore 46 relative to the foremost end of the nose portion 23 and relative to the openings 106, 108 in tooth 14 thereby ensuring proper operation of the fastener 16. That is, the flats 53 of the stabilizing lands are disposed generally perpendicular to the vertical axis 48 of bore 46. As such, the flats 53 are disposed to inhibit the tool used to create the bore 46 from dancing along the slanted surface of the adapter, thus enhancing creation of the bore 46.

Another embodiment of an excavating tooth assembly embodying features of the present invention is illustrated in FIGS. 5 and 6. This alternative form of excavating tooth assembly is designated generally by reference numeral 210. The elements of this alternative form of excavating tooth assembly that are identical or functionally analogous to those components discussed above regarding tooth assembly 10 are designated by reference numerals identical to those used above with the exception that this embodiment uses reference numerals in the two hundred series.

In this embodiment of the invention, a lengthwise section of the nose portion 223 of the adapter 212 extends within a cavity 272 defined by the digging tooth 214. Like that discussed above, the nose portion 223 of the adapter 212 terminates in an end portion 231. The cavity 272 defined by tooth 214 is similarly shaped to that discussed above and includes converging interior slanted surfaces 274 and 276 which diverge angularly and rearwardly from an end wall 281 defined by cavity 272 of tooth 214. Preferably, the end wall 281 of cavity 272 is complimentary to and generally parallels the end region 231 of adapter 212 as shown in FIG. 6.

In this alternative form of the invention, an elastomeric material is disposed between the adapter 212 and 214 for inhibiting movement therebetween during the operation of the excavating tooth assembly 210 thereby reducing impact forces between confronting surfaces defined on the adapter 212 and 214.

The elastomeric material disposed between the adapter 212 and excavating tooth 214 is preferably formed from copolymer elastomers such as Hytrel®, an elastomer manufacture by E.I. duPont de Nemoirs. U.S. Pat. Nos. 4,198,037 and 4,566,678 of David G. Anderson and assigned to Miner Enterprises of Geneva, Ill. better describe and disclose particular characteristics of such copolymer elastomers; with the full teachings and disclosure of the above-mentioned Anderson patents being incorporated and embodied herein by reference. Suffice it to say, the elastomeric material used in the present invention has a ratio of plastic deformation to elastic deformation which is greater than 1.5 to 1.

As schematically represented in FIGS. 5 and 6, an elastomeric member 250 is disposed between the free end 231 of the nose portion 223 of adapter 212 and the terminal wall 281 of cavity 272 defined by tooth 214. The elastomeric member 250 is formed from the same elastomeric material mentioned above. The purpose of the elastomeric member 250 is for absorbing endwise directed impact forces between the tooth 214 and the adapter 212 during operation of the excavating tooth assembly 210.

Alternatively, and as shown in FIG. 7, an elastomeric member 250' can also be disposed between the nose portion 223 of the adapter and the terminal wall 281 of cavity 272 to act as a spring. That is, the member 250' can have a wave-like or rippled configuration between opposite lateral ends thereof and be disposed between the free end 231 of the nose portion 223 of the adapter 212 and the terminal wall 281 of cavity 272 defined on tooth 214. The rippled or sinusoidal configuration of the elastomeric member 250' provides a spring-like effect which augments the locking function of the fastener 216.

Another alternative embodiment of an excavating tooth assembly using elastomeric material between component parts thereof is illustrated in FIG. 8. This alternative form of excavating tooth assembly is designated generally by reference numeral 310. The elements of this alternative form of excavating tooth assembly that are identical or functionally analogous to those components discussed above regarding tooth assembly 10 illustrated in FIGS. 1 through 4 are designated by reference numerals identical to those used above with the exception that this embodiment uses reference numerals in the three-hundred series.

In this embodiment of the invention, a layer of elastomeric material 350 similar to that disclosed above and having a ratio of plastic deformation to elastic deformation which is greater than 1.5 to 1 is disposed between the exterior slanted upper surface 324 of the nose portion 323 of adapter 312 and the slanted interior surface 374 defined by cavity 372 of tooth 314. Similarly, a layer of elastomeric material 350 of the type having a ratio of plastic deformation to elastic deformation which is greater than 1.5 to 1 is disposed between the exterior slanted surface 326 of the nose portion 323 on adapter 312 and the interior slanted surface 376 defined by cavity 372 in tooth 312.

With this embodiment of the invention, each layer of elastomeric material 350 extends generally the length of the nose portion 323 of adapter 312 and is disposed across the width of those surfaces defined between opposite lateral side edges thereof. As such, elastomeric material disposed along the upper and lower slanted surfaces 324 and 326 and between opposed lateral side edges of the adapter 312 also covers the confronting generally flat surfaces 343 and 303 defined by the stabilizing lands 342 and 302 on adapter 312 and tooth 314 respectively. Moreover, with this embodiment of the invention, elastomeric material 350 is disposed between the confronting generally flat surfaces 353 and 393 defined by the stabilizing lands 352 and 392, respectively, of the adapter 312 and tooth 314. As will be appreciated, the predetermined distances separating the various flat surfaces 343, 303 and 353, 393 of the stabilizing lands 342, 302 and 352, 392, respectively, on the adapter 312 and tooth 314 may require slight modification when elastomeric material is to be arranged therebetween.

In this embodiment of the invention, elastomeric material 350 is also preferably provided between the confronting and generally vertical stabilizing walls 344 and 304 of the forwardly disposed stabilizing lands 342 and 302 on the adapter 312 and tooth 314 respectively. Similarly, elastomeric material 350 is preferably provided between the confronting and generally vertical stabilizing walls 354 and 394 of the rearwardly disposed stabilizing lands 352 and 392 defined between the adapter 312 and tooth 314 respectively. As will be appreciated from an understanding of the present invention, the provision of elastomeric material between the stabilizing walls defined by the fore-and-aft spaced of pairs of stabilizing lands defined on the adapter 312 tooth 314 substantially reduces, if not eliminates, and tolerance gaps or voids between the stabilizing walls thereby reducing impact forces therebetween occurring during operation of the excavating tooth assembly 310.

Still another alternative form of the invention using elastomeric material is illustrated in FIGS. 9 and 10. This alternative form of excavating tooth assembly is generally designated by reference numeral 410. The elements of this invention that are the same as or functionally analogous to those components discussed above regarding excavating tooth assembly 10 shown in FIGS. 1 though 4 are designated by reference numerals identical to those used above with the exception that this embodiment uses reference numerals in the four-hundred series.

In this embodiment of the invention, an elongated and close-ended hollow sleeve 450 of elastomeric material similar to that discussed above and preferably having a ratio of plastic deformation to elastic deformation which is greater than 1.5 to 1 is disposed about and along the nose portion 423 of the adapter 412 before the excavating tooth 414 is arranged in operable combination therewith. As such, and after the excavating tooth 414 is fitted along and about the nose portion 423 of the adapter 412, and as shown in FIGS. 9 and 10, a closed-end 451 of sleeve 450 is entrapped between the free end 431 of the nose portion 423 of adapter 412 and the terminal wall 481 defined by the cavity 472 and the tooth 412.

Similarly, and after tooth 414 is arranged in operable combination with the adapter 412, elastomeric material of sleeve 450 will be entrapped, as shown in FIG. 9, between confronting slanted interior and exterior surfaces 424, 426 and 474, 476 of the adapter 412 and excavating tooth 414, respectively. Moreover, and after the tooth 414 is fitted along and about and arranged in operable combination with the nose portion 423 of the adapter 412, elastomeric material of sleeve 450 will be entrapped between the sidewalls 428, 430 of the adapter 412 and the side walls 478, 480 of the cavity 472 defined by tooth 414. As will be appreciated, the dimensioning of the nose portion 423 of adapter 412 and the blind cavity 472 defined by tooth 414 may require slight modification when an elastomeric sleeve such as 450 is fitted along and about the nose portion 423 of the adapter such that a layer of elastomeric material encapsulates the nose portion 423 of the adapter and is disposed between confronting surfaces of the adapter 412 and tooth 414.

The provision of elastomeric material having a ratio of plastic deformation to elastic deformation which is greater than 1.5 to 1 between adjacent and abutting surfaces of the adapter and tooth of multipiece excavating tooth assembly offers significant enhancements over the prior art. For example, the elastomeric material disposed between the nose portion of the adapter and the terminal wall of the cavity defined by the tooth tends to deform in response to horizontal impact forces being exerted on the excavating tooth during an excavating operation. This elastomeric material further serves to augment the locking function of a two piece fastener assembly of the type described above.

In a preferred form of the invention, and to add sufficient strength and rigidity to the components of the multipiece tooth assembly, the adapter and tooth are preferably fabricated in a forging operation. The elastomeric material disposed between adjacent and confronting surfaces readily fills tolerance voids and gaps between the adjacent and confronting surfaces on the forged tooth and adapter thereby significantly and advantageously cushioning impact forces occurring between the adjacent confronting surfaces of the multipiece tooth assembly during an excavating operation. As will be appreciated, reducing impact between adjacent surfaces on the adapter and tooth prolongs usefulness of the multipiece tooth assembly, and, thus, offers significant economic advantages over the prior art.

From the foregoing, it will be observed that numerous modifications and variations can be effected without departing from the true spirit and scope of the novel concept of the present invention. It will be appreciated that the present disclosure is intended to set forth exemplifications of the invention, which are not intended to limit the invention to the specific embodiments illustrated. The disclosure is intended to cover by the appended claims all such modifications as fall within the scope of the claims.

What is claimed is:

1. An excavating tooth assembly comprising:

an adapter having an outer tapered surface configured with a substantially horizontal rearward land section and a substantially horizontal forward land section, said rearward and forward land sections each having a substantially similar and generally semicircular shape, each semicircular shape including a vertical wall configured to facilitate transmission of lateral forces acting on the tooth assembly; and an excavating tooth configured for attachment to the adapter and having a hollow mounting end defining a cavity configured to mate with the adapter, said hollow mounting end including an inner tapered surface adapted to mate with said outer tapered surface of the adapter, said inner tapered surface configured with a substantially horizontal rearward transmitting section adapted to mate with said rearward land section of the adapter, and a substantially horizontal forward transmitting section adapted to mate with said forward land section of the adapter, said rearward and forward transmitting sections each having a substantially similar and generally semicircular shape complementary to the semicircular shape of the rearward and forward land sections on said adapter, with each semicircular shape on said transmitting sections of said tooth including a vertical wall configured to mate with the substantially vertical wall on the rearward and forward land sections of said adapter to facilitate transmission of the lateral forces from the excavating tooth to the adapter.

2. The assembly of claim 1 wherein the substantially vertical walls of the forward land section and the forward transmitting section correspondingly diverge at least partially from a plane normal to a longitudinal centerline of the adapter, and the substantially vertical walls of the rearward land section and the rearward transmitting section correspondingly diverge at least partially from the plane normal to the longitudinal centerline of the adapter, thereby facilitating transmission of the lateral forces from the excavating tooth to the adapter.

3. The assembly of claim 1 wherein the forward land section is defined as a recess formed in the outer tapered surface of the adapter and the forward transmitting section protrudes outwardly from the inner tapered surface of the excavating tooth, and wherein the rearward land section protrudes outwardly from the outer tapered surface of the adapter, and the rearward transmitting section is defined as a recess formed in the inner tapered surface of the excavating tooth.

4. The assembly of claim 1 wherein a forward end portion of said adapter diverges at least partially from a plane normal to a longitudinal centerline of said adapter, and said cavity in the excavating tooth further comprises a correspondingly forward end portion in abutting relationship with the forward end portion of the adapter to facilitate transmission of lateral forces from the excavating tooth to the adapter.

5. The assembly of claim 4 wherein said forward end portion of the adapter is bowed outwardly and the forward end portion of the cavity is a corresponding concave shape for matingly receiving said adapter.

6. The assembly of claim 1 wherein the rearward land section of the adapter has a bore extending therethrough, and the rearward transmitting section of the tooth has a hole therein to act in conjunction with said bore for the insertion of a fastener therethrough to secure said tooth to said nose piece.

7. The assembly of claim 1 wherein said forward and rearward land sections are formed in an upper, outer tapered surface of the adapter, and said forward and rearward transmitting sections are formed in an upper, inner tapered surface of the excavating tooth, and further comprising corresponding second forward and rearward land sections formed in a lower outer tapered surface of the adapter, and corresponding second forward and rearward transmitting sections formed in a lower inner tapered surface of the excavating tooth.

8. An excavating tooth assembly comprising:

an adapter having an outer tapered surface with a substantially horizontal rearward land section protruding outwardly therefrom and a substantially horizontal forward land section defined as a recess therein, said rearward and forward land sections each having a substantially similar and generally semicircular shape opening to a forward end of said adapter, with each semicircular shape including a generally vertical wall diverging at least partially from a plane normal to the longitudinal centerline of the adapter thereby facilitating transmission of lateral forces acting on said tooth assembly; and an excavating tooth attached to the adapter and having a hollow mounting end defining a cavity configured to mate with the adapter, said hollow mounting end including an inner tapered surface adapted to mate with said outer tapered of the adapter, said inner tapered surface having a substantially horizontal rearward transmitting section defining a recess adapted to mate with said rearward land section of the adapter, and a substantially horizontal forward transmitting section protruding therefrom for mating with said forward land section of the adapter, said rearward and forward transmitting sections each having a substantially similar and generally semicircular shape opening to the hollow mounting end of said tooth and which are complementary to the semicircular shape of the rearward and forward horizontal land sections on said adapter, with each semicircular shape of the transmitting sections on said tooth including a vertical wall diverging to mate with the vertical walls of the rearward and forward land sections on the adapter to facilitate transmission of lateral forces from the excavating tooth to the adapter.

9. The assembly of claim 8 wherein a forward end portion of the adapter is bowed outwardly and a forward end portion of the cavity is a corresponding concave shape for matingly receiving said adapter.

10. The assembly of claim 8 wherein the rearward land section of the adapter has a bore extending therethrough, and the rearward transmitting section of the tooth has a hole therein to act in conjunction with said bore for the insertion of a fastener therethrough to secure said tooth to said adapter.

11. The assembly of claim 8 wherein said forward and rearward land sections are formed in an upper, outer tapered surface of the adapter, and said forward and rearward transmitting sections are formed in an upper, inner tapered surface of the excavating tooth, and further comprising second forward and rearward land sections formed in a lower, outer tapered surface of the adapter, and second forward and rearward transmitting sections formed in a lower, inner tapered surface of the excavating tooth, with the second forward and rearward land sections on the adapter being adapted to mate with the second forward and rearward transmitting sections on the excavating tooth so as to effect transference of forces from said tooth to said adapter.

12. An excavating tooth for a ground engaging implement comprising:

an elongated wedge shaped member defining a longitudinal axis and having a forward end extending generally transverse to the longitudinal axis and a blind cavity opening to a rear end of said member, said wedge shaped member defining a pair of axially aligned holes disposed along a vertical axis which passes through said blind cavity, and wherein said blind cavity includes laterally spaced side surfaces with upper and lower tapered surfaces converging toward a forward end of said cavity, with each tapered surface having a rearwardly disposed substantially horizontal transmitting section including a relatively flat generally horizontal stabilizing surface defined by a recess in the tapered surfaces of the blind cavity and through which one of said holes defined by said tooth extends, with each stabilizing surface having a lateral width less than the lateral spacing between said side surfaces of said cavity and wherein each transmitting section further includes a generally vertical wall disposed at least partially to opposite lateral sides of said vertical axis and extending at least partially in a fore-and-aft direction between said flat generally horizontal stabilizing surface and a respective tapered surface on said elongated wedge shaped member.

13. The excavating tooth according to claim 12 wherein each rearwardly disposed horizontal transmitting section on said member opens to a forward end of said cavity, and wherein said generally vertical wall of each horizontal transmitting section diverges at least partially from a plane normal to the longitudinal axis of said member.

14. The excavating tooth according to claim 13 wherein said vertical walls are generally shaped in the form of a semi-circle at least partially surrounding a respective support surface.

15. The excavating tooth according to claim 12 wherein a forward end portion of said cavity has a concave configuration.

16. The excavating tooth according to claim 12 wherein each tapered surface of said blind cavity is provided with a forwardly disposed substantially horizontal transmitting section defined by projections extending from the tapered surfaces of the blind cavity defined by said member.

17. The excavating tooth according to claim 16 wherein each forwardly disposed horizontal transmitting section on said member further includes a generally vertical wall diverging at least partially from a plane normal to the longitudinal axis of said member between a support surface extending generally parallel to the longitudinal axis of said member and a respective tapered surface defined by said cavity.

18. The excavating tooth according to claim 17 wherein said vertical walls are generally shaped in the form of a semi-circle at least partially surrounding a respective support surface.

19. An adapter for an excavating implement, comprising:

an axially elongated member having a nose portion defining a longitudinal axis and a pair of outer tapered surfaces converging toward a forward end of the nose portion of said member, with the nose portion of said member further including laterally spaced sides extending between said outer tapered surfaces, and wherein said nose portion of said elongated member further includes a bore disposed toward a rear end of said nose portion and defining a generally vertical axis, with each tapered surface on said nose portion having a rearwardly disposed substantially horizontal land section including a relatively flat generally horizontal stabilizing surface extending normal to and intersecting with said vertical axis and which is defined by a projection extending from a respective tapered outer surface on the nose portion of said member, with the flat generally horizontal stabilizing surface of each horizontal land section having a lateral width less than the spacing between the sides of the nose portion of said member, and wherein each horizontal land section on the nose portion of said member further includes a generally vertical wall disposed at least partially to opposite sides of said vertical axis and extending at least partially in a fore-and-aft direction between said flat generally horizontal stabilizing surface and a respective tapered surface on the nose portion of said member.

20. The adapter according to claim 19 wherein said bore extends through said member and is open at opposed ends thereof.

21. The adapter according to claim 19 wherein each rearwardly disposed substantially horizontal land section on the nose portion of said member opens to a forward end of said member, and wherein said generally vertical wall of each horizontal land section diverges at least partially from a plane normal to the longitudinal axis of said member.

22. The adapter according to claim 21 wherein said vertical walls are generally shaped in the form of a semi-circle at least partially surrounding a respective support surface.

23. The adapter according to claim 19 wherein a forward end portion of said member has an outwardly bowed configuration.

24. The adapter according to claim 19 wherein each tapered surface of said member further includes a forwardly disposed substantially horizontal land section defined by a recess extending inwardly from one of said outer tapered surfaces on said member.

25. The adapter according to claim 24 wherein each forwardly disposed horizontal land section on said member further includes a generally vertical wall diverging at least partially from a plane normal to the longitudinal axis of said member between a support surface extending generally parallel to the longitudinal axis of said member and a respective tapered outer surface on said member.

26. The adapter according to claim 25 wherein said vertical walls are generally shaped in the form of a semi-circle at least partially surrounding a respective support surface.

27. An assembly for releasably attaching an excavating tooth to an excavating implement, comprising:

an adapter defining a longitudinal axis and having a base portion attachable to the excavating implement and a nose portion extending forwardly from the base portion, said nose portion having laterally spaced sides and converging upper and lower surfaces terminating at a forward end, said adapter defining an elongated aperture open at opposite ends and defining a generally vertical axis arranged generally coplanar with the longitudinal axis of said adapter, and with the upper and lower surfaces of said adapter defining, in combination, at least three generally parallel stabilizing support surfaces, each stabilizing support surface opening to the forward end of the adapter, with each stabilizing support surface being at least partially surrounded by a generally vertical wall extending normal to and between a stabilizing support surface and the respective upper and lower surfaces of the adapter, with each stabilizing support surface having a lateral width less than the spacing between the sides of the nose portion of the adapter, and wherein the generally vertical wall of each stabilizing support surface extends at least partially in a fore-and-aft direction and on opposite lateral sides of said longitudinal axis;

said excavating tooth defining a blind cavity configured to snugly fit endwise about the nose portion of the adapter, with the blind cavity defined by said tooth having upper and lower surfaces that complement the upper and lower surfaces of said nose portion of the adapter and include structure for abutting and cooperating with the three stabilizing support surfaces on the adapter, said structure including generally vertical wall structure which, when said tooth and adapter are arranged in operable combination relative to each other, abuts with the generally vertical wall at least partially surrounding each stabilizing support surface of the adapter to transfer side load forces imparted to the tooth toward the longitudinal axis of the adapter, said tooth further defining a pair of axially aligned openings that open to the cavity of the tooth and operate in conjunction with the elongated aperture defined by the adapter; and pin structure extendable through the openings in the tooth and through the aperture in said adapter to releasably hold the tooth and the adapter in operable combination relative to each other.

28. An assembly for attaching an earth engaging tooth to a ground engaging implement, comprising:

a support defining a longitudinal axis and having a base attachable to the implement and a nose extending forwardly from the base, said nose having laterally spaced sides and converging upper and lower surfaces terminating at a forward end, said support defining an elongated aperture open at opposite ends, said aperture defining a generally vertical axis arranged generally coplanar with the longitudinal axis of the adapter and with the upper and lower surfaces defining, in combination, at least three generally parallel stabilizing support surfaces, with each stabilizing support surface opening to the forward end of the support, and wherein each stabilizing support surface extends generally horizontal and includes a wall at least partially extending in a fore-and-aft direction to opposite lateral sides of said longitudinal axis and between a respective stabilizing support surface and the respective upper or lower surfaces of the support;

said tooth having a blind cavity including upper and lower surfaces that complement the upper and lower surfaces of said nose of the support, with said upper and lower surfaces of said blind cavity including structure for abutting and cooperating with the three stabilizing support surfaces on the support, said structure including generally vertical and at least partially fore-and-aft extending wall structure which, when said tooth and support are arranged in operable combination relative to each other, abuts with the walls of the stabilizing support surfaces on said upper and lower surfaces of the cavity defined by said tooth to facilitate transference of lateral forces imparted to said tooth during an excavating operation to said support, said tooth further defining a pair of axially aligned holes opening to the cavity in the tooth and which act in conjunction with the elongated aperture defined by said support; and pin structure extendable through the holes in the tooth and through the elongated aperture in said support to releasably hold the tooth to the support.

29. An assembly for attaching a ground engaging tooth to a ground engaging implement comprising:

a support attachable at a rear end to the implement and having a nose extending forwardly to a free terminal end, said nose having laterally spaced and opposed sides and upper and lower surfaces converging toward the terminal end of said support, with the nose of said support further defining an opening extending through the nose of the support toward the rear end thereof and which is open at opposite ends, said opening defining a generally vertical axis, said upper and lower surfaces on said support each defining a pair of fore-and-aft spaced stabilizing supports, with each stabilizing support having a lateral width less than the spacing between said opposed sides of said support and opening to the terminal end of said support, each stabilizing support including a generally horizontal stabilizing surface with a generally vertical wall extending in at least partially surrounding relation relative to said vertical axis between the respective generally horizontal stabilizing surface and the respective upper and lower surfaces of the support;

said tooth defining a blind cavity configured to snugly fit endwise about the nose of the support and including upper and lower surfaces that complement the upper and lower surfaces on the nose of the support, with the upper and lower surfaces of the blind cavity each including first and second structures for abutting and cooperating with the pairs of stabilizing supports on the upper and lower surfaces of the support, with each structure including generally vertical wall structure which, when said support and tooth are arranged in operable relationship relative to each other, abuts with the generally vertical wall on a respective stabilizing support to facilitate transfer of side loads imparted to the tooth toward a center of the support, said tooth further defining a pair of holes arranged in axially aligned relation relative to each other and along a centerline passing through the blind cavity in the tooth to act in conjunction with the opening in the support; and pin structure extendable though the holes in the tooth and the opening in said support for releasably attaching said tooth and said support in operable relationship relative to each other.

30. An assembly for attaching a ground engaging tooth to a ground engaging implement, comprising:

a support attachable at a rear end to the implement and having a nose extending forwardly to a free terminal end with a forwardly projecting curvilinear configuration, said nose having laterally spaced and opposed sides and upper and lower surfaces converging toward the terminal end of said support, said support further defining an opening extending through the support toward a rear end of the nose of the support and which is open at opposite ends, said opening defining a generally vertical axis, with said upper and lower surfaces each defining first and second fore-and-aft spaced and vertically aligned pairs of stabilizing supports, with each stabilizing support having a lateral width less than the spacing between said opposed sides of said support, with the first pair of stabilizing supports on the upper and lower surfaces of the support extending rearwardly from and opening to the terminal end of the support and with the second pair of stabilizing supports on the upper and lower surfaces of the support being disposed toward a rear end of the nose of the support, each stabilizing support on said support including a generally flat and horizontal surface with a generally vertical wall extending at least partially to opposite lateral sides of the vertical axis between the horizontal surfaces and a respective upper and lower surface of the support;

said tooth defining a blind cavity configured to snugly fit endwise about the nose of the support and including upper and lower surfaces that complement the upper and lower surfaces on the nose of the support, wherein the blind cavity of the tooth defines a curvilinear surface that is a mirror image of the curvilinear configuration at the terminal end of the support such that the tooth is subject to self-centering in response to horizontal loads being applied thereto, and with the upper and lower surfaces of the blind cavity each including first and second pairs of structures for abutting and cooperating with the first and second pairs of stabilizing supports on the upper and lower surfaces of the support, and wherein each pair of structures on the tooth defines a generally vertical wall which, when the support and tooth are arranged in operable relationship relative to each other, abut with the vertical wall of a complementary stabilizing support on said support to transfer side loads imparted to the tooth toward a center of the support, said tooth further defining a pair of axially aligned holes opening to the blind cavity in the tooth and arranged in conjunction with the opening defined by said support; and pin structure extendable through the holes in the tooth and the opening in said support for releasably attaching said tooth and said support in operable relationship relative to each other.

* * * * *